US008585434B2

(12) United States Patent
Yu

(10) Patent No.: US 8,585,434 B2
(45) Date of Patent: Nov. 19, 2013

(54) POWER SOCKET

(76) Inventor: Guolin Yu, Zhejiang (CN)

( * ) Notice: Subject to any disclaimer, the term of this patent is extended or adjusted under 35 U.S.C. 154(b) by 122 days.

(21) Appl. No.: 13/269,788

(22) Filed: Oct. 10, 2011

(65) Prior Publication Data

US 2012/0088411 A1 Apr. 12, 2012

(30) Foreign Application Priority Data

Oct. 12, 2010 (CN) ..... 2010 1 0505922

(51) Int. Cl.
*H01R 11/00* (2006.01)

(52) U.S. Cl.
USPC ..... 439/502; 439/110

(58) Field of Classification Search
USPC ..... 439/502, 110
See application file for complete search history.

(56) References Cited

U.S. PATENT DOCUMENTS 5,439,390 A * 8/1995 Raynor et al. ..... 439/502
6,750,410 B2 * 6/2004 Lee ..... 200/51.03
6,939,180 B1 * 9/2005 Wu ..... 439/650
7,057,108 B1 * 6/2006 Sodemann et al. ..... 174/71 R
7,371,121 B1 * 5/2008 Lee ..... 439/650
7,575,436 B1 * 8/2009 Devlin et al. ..... 439/21
7,950,941 B1 * 5/2011 Wang ..... 439/214
2004/0248462 A1 * 12/2004 Dyer et al. ..... 439/502
2007/0026728 A1 * 2/2007 Mak ..... 439/505
2008/0139022 A1 * 6/2008 Chen et al. ..... 439/101

* cited by examiner

*Primary Examiner* — Truc Nguyen
(74) *Attorney, Agent, or Firm* — Global IP Services; Tianhua Gu

(57) ABSTRACT

A power socket comprises a housing which is composed of an upper cover and a lower seat, equipped with a master wire and a plurality of sub-wires, a pair of seat bodies are formed on the upper cover, a plurality of fixing plates are disposed at the side of each seat body, the grooves formed between adjacent fixing plates and the seat body become fixing grooves; the same definition line of each sub-wire connects with the same definition line of an output of a circuit board, and a plurality of welding points are formed which are respectively inserted in the corresponding fixing grooves. The power socket has fast and quick installation and the arc electricity can be avoided effectively to ensure the safe and reliable use. The power socket is compacted in an integral structure and can be safely used to satisfy diversified needs.

10 Claims, 3 Drawing Sheets

POWER SOCKET

CROSS REFERENCE TO RELATED PATENT APPLICATION

The present application claims the priority of the Chinese application No. 201010505922.X filed on Oct. 12, 2010, which application is incorporated herein by reference.

FIELD OF THE INVENTION

The present invention relates to a kind of power socket.

DESCRIPTION OF THE PRIOR ART

In the existing multi-hole socket, a plurality of holes are designed on a plug board and each set of holes are disposed near with each other, and thus, due to the limited hole distance and different sizes of plugs, a plurality of unused holes may be easily covered in, which decreases the utilization rate of holes. Therefore, many kinds of new-style power sockets are developed, for example, a Chinese Patent ZL200920099265.6 (Publication No.: CN201387975Y) disclosed a flexible wire connection multi-hole socket, which comprises a master wire which is a flexible wire one end of which connects with the power plug, and the other end of the master wire connects with a plurality of flexible sub-wires that respectively connect with a small socket. Such socket may be carried in a very convenient way, but still need to be improved due to the poor safety as a result of the absence of a plug board and a power switch. Another Chinese Patent ZL200920116946.9 (Publication No.: CN201387973Y) disclosed another power socket, it comprises a housing with a switch, characterized in that a plurality of sockets electrically connect with the housing via respective wires and the housing connects with plugs via wires, therefore forming a circuit thereon between the sockets and the external power via the switch. In this power socket, each socket respectively locates on different planes via flexible wires, therefore, the plug is inserted into the holes of each socket may not be mutually affected with other socket. Furthermore, each socket is provided with an individual wire and holes and it will not be affected at whatever angles when using, and as the wires and the sockets are made of flexible insulation materials, it will be conveniently used at any blind angle and narrow location. This kind of power socket can enhance the use safety, but it also has disadvantage that all wires are connected in the traditional rigmarole way, which results in a decreasing efficiency of production and an easy occurrence of arc electric spark affecting the safe use. Therefore the design of the multiple wires in the housing still needs to be improved.

SUMMARY OF THE INVENTION

It is an object of the present invention to provide a power socket with the advantage of fast and quick installation, and the arc electricity may be avoided effectively to ensure the safe and reliable use.

For achieving the above stated object, the power socket comprises:

a housing which is composed of an upper cover and a lower seat, equipped with a master wire which connects with a master plug, and equipped with a plurality of sub-wires at the periphery of the housing which respectively connects with a plurality of sub-sockets;

characterized in that a pair of seat bodies are formed on the inner wall of the upper cover for metal contact pieces to install, a plurality of fixing plates are disposed at the side of each seat body, the grooves formed between adjacent two fixing plates and between the fixing plate and the corresponding seat body become fixing grooves;

each sub-wire has three lines which are defined as a fire line, a ground line and a zero line, the same definition line of each sub-wire connects with the same definition line of an output of a circuit board through intertwisting and welding with each other, and a plurality of welding points are formed which are respectively inserted and positioned in the corresponding fixing grooves.

Preferably, the number of the fixing plates at side of each seat body is three, and three fixing plates are parallel with the seat body, accordingly the fixing grooves at side of each seat body are three which are defined respectively as a zero line fixing groove, a fire line fixing groove and a ground line fixing groove from outer to the seat body.

Preferably, the width of each fixing groove is uniform.

Preferably, the upper cover is equipped with 2-4 three-hole socket units, and the holes of the three-hole socket units on the upper cover locate in the seat bodies and between the pair of the seat body, metal contact pieces for the fire line or the zero line are disposed in the seat bodies and metal contact piece for the ground line is disposed between the pair of the seat body. Therefore, the socket units on the housing and the sub-sockets are combined, it is convenient to use and the range of usage is also increased.

Preferably, the circuit board is disposed in the housing, the input of the circuit board connects with the master wire, a control switch is fixed on the circuit board, the upper cover has a corresponding through hole to control the control switch.

Preferably, the sub-wires are flexible wires, and the housings of the sub-sockets are made from insulating flexible material and the number of the sub-sockets is 4-6.

Preferably, both of the periphery of the upper cover and the lower seat have a plurality of half-holes, the half-holes on the upper cover respectively match with the corresponding half-holes on the lower seat forming rounded holes respectively for each sub-wire to pass through the housing. Preferably, connecting protrusions are disposed at the inner of the upper cover respectively at least at the two sides of each sub-wire, the lower seat has connecting recesses for the corresponding connecting protrusions to insert in which are fixed with corresponding connecting protrusion through a screw.

Compared with the prior art, in this invention, the fixing grooves are formed between a plurality of fixing plates inside the housing, the same definition line of each sub-wire connects with the same definition line of an output of a circuit board through intertwisting and welding with each other, and a plurality of welding points are formed which are respectively inserted and positioned in the corresponding fixing grooves. In this way, the connection will be established firmly with fast and quick installation and the arc electricity can be avoided effectively to ensure the safe and reliable use. At the same time, the housing is equipped with sub-sockets and a switch, therefore the effective utilization of the whole socket can be ensured. The power socket of the present invention is compacted in an integral structure and can be safely used to satisfy diversified needs.

DETAILED DESCRIPTION OF THE PREFERRED EMBODIMENT

Figure 1:
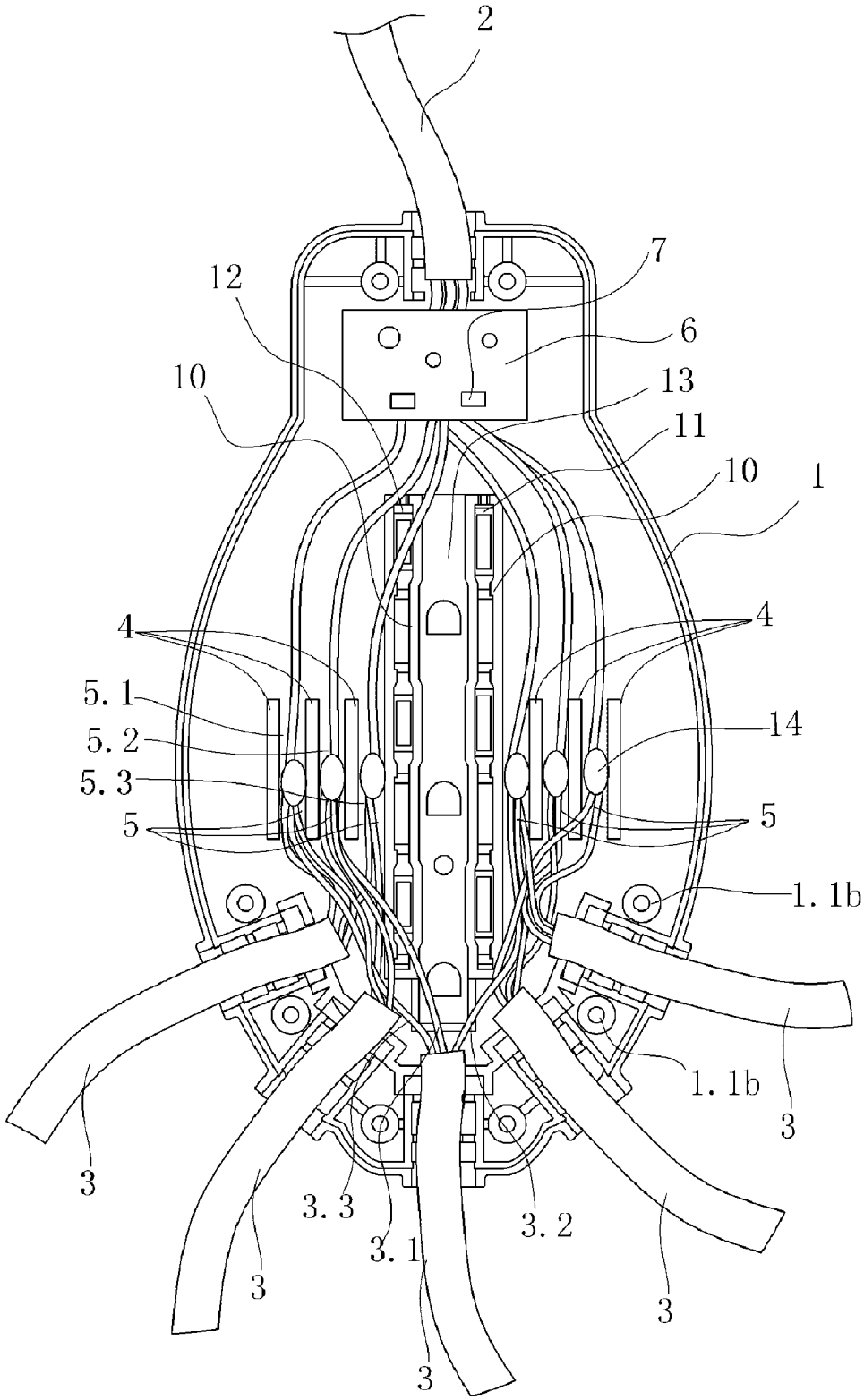
FIG. 1 is a sectional view of a power socket in accordance with the embodiment of the present invention.
Figure 2:
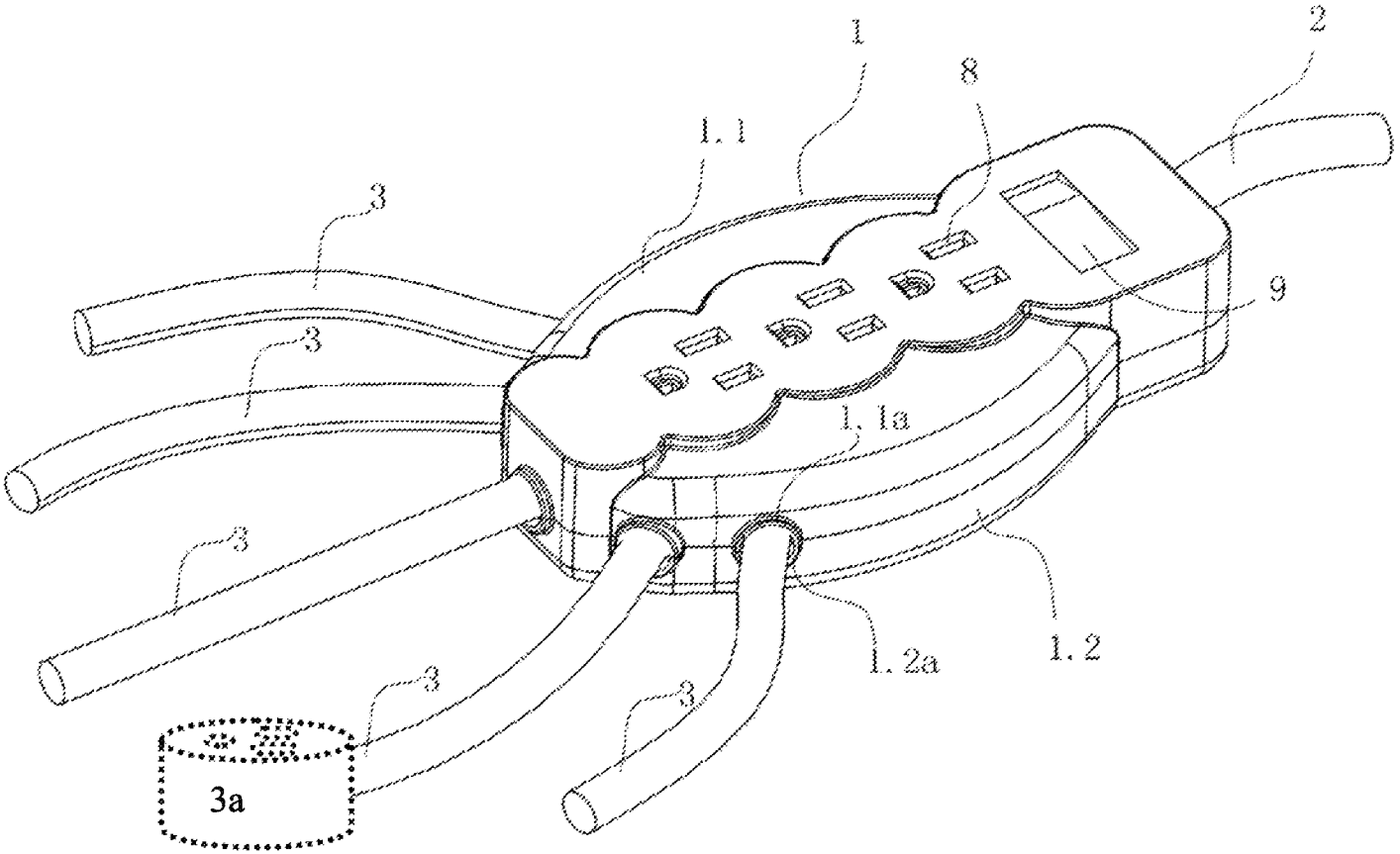
FIG. 2 is a perspective view of the power socket in accordance with the embodiment of the present invention.
Figure 3:
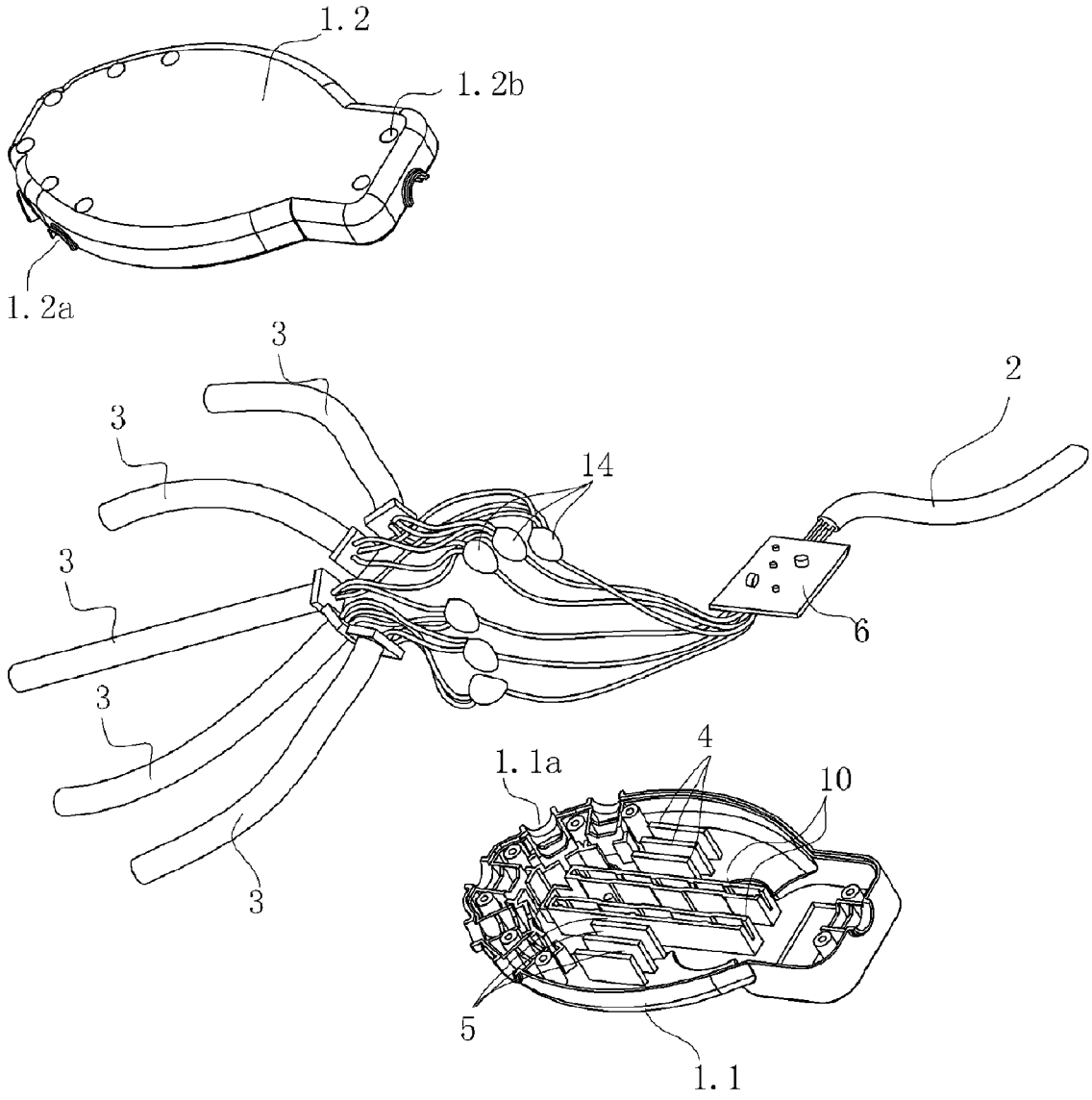
FIG. 3 is an exploded perspective view of the power socket in accordance with the embodiment of the present invention.

To enable a further understanding of the innovative and technological content of the invention herein, refer to the detailed description of the invention and the accompanying drawings below:

FIG. 1-3 show the preferred embodiment of the present invention.

A power socket comprises a housing (1) in a mouse-like shape, a master plug, a control switch (9) and 5 sub-sockets (3*a*). The control switch (9) is disposed behind the housing (1). A master wire (2) disposed on the rear end of the housing (1) connects with the master plug, and five sub-wires (3) disposed at the periphery of the front end of the housing (1) respectively connect with five sub-sockets (3*a*), therefore the sub-sockets (3*a*) can connect with the master plug via the housing (1). On the surface of the housing (1), 3 three-hole socket units (8) are disposed in parallel. The housing (1) is composed of an upper cover (1.1) and a lower seat (1.2), and the upper cover (1.1) is provided with the holes of 3 three-hole socket units (8), respectively arranged on the underside of the upper cover (1.1) which is a traditional techniques.

The invention is characterized in that: a pair of seat bodies (10) are formed on the inner wall of the upper cover (1.1) for metal contact pieces (11, 12) to install, three fixing plates (4) are respectively disposed at the side of each seat body (10) on the upper cover (1.1), and the fixing plates (4) are parallel with the seat body (10), accordingly the grooves formed between adjacent two fixing plates (4) and between the fixing plate (4) and the corresponding seat body (10) become fixing grooves (5) which is with uniform width, and three fixing grooves (5) at side of each seat body (10) are defined respectively as a zero line fixing groove (5.1), a fire line fixing groove (5.2) and a ground line fixing groove (5.3) from outer to the seat body (10);

Each sub-wire (3) has three lines which are defined as a fire line (3.1), a ground line (3.2) and a zero line (3.3);

The input of the circuit board (6) in the power socket connects with the fire line, the ground line and the zero line of the master wire (2) respectively, furthermore, the output (7) of the circuit board (6) in the power socket is divided into two sub-outputs each provided with connecting ends respectively for the fire line (3.1), the ground line (3.2), and the zero line (3.3);

The same definition line of each sub-wire (3) respectively connects with the connecting ends of the output (7) with the same definition through intertwisting and welding with each other, and welding points (14) of the fire line (3.1), the ground line (3.2), and the zero line (3.3) are formed which are respectively inserted and positioned in the fire line fixing groove (5.2), the ground line fixing groove (5.3) and the zero line fixing groove (5.1);

The holes of the three-hole socket units (8) locate in the seat bodies (10) and between the pair of the seat bodies (10), metal contact pieces (11, 12) for the fire line (3.1) or the zero line (3.2) are disposed in the seat bodies (10) and metal contact piece (13) for the ground line (3.3) is disposed between the pair of the seat bodies (10); and the metal contact pieces (11, 12) of the fire line (3.1), the zero line (3.3) or the ground line (3.2) connect with the circuit board (6). In this way, the installation can be achieved in a convenient and fast way and the contact between adjacent welding points (14) can be avoided to effectively prevent the arc electricity and enhance the safety;

Both of the periphery of the upper cover (1.1) and the lower seat (1.2) have 5 half-holes (1.1*a*, 1.2*a*), the half-holes on the upper cover (1.1) respectively match with the corresponding half-holes on the lower seat (1.2) forming rounded holes respectively for each sub-wire (3) to pass through the housing (1) for connection with the circuit board (6); the sub-wires (3) connecting with five sub-sockets (3*a*) are made of flexible wires and these five sub-sockets (3*a*) locate at different positions, a0ccordingly, the plug inserted into the holes of each sub-socket will not be mutually affected with other sub-socket. The sub-wires (3) are provided with different lengths for the convenience of use.

The yellow sub-sockets (3*a*) and the main body of plugs look basically the same in appearance. The sub-sockets (3*a*) have socket shells made of flexible insulation materials, and can be used in a more convenient, safe and flexible way; the circuit board (6) locates in the housing (1) and the bottom of the control switch (9) is fixed on the circuit board (6), accordingly a circuit can be formed between the sub-sockets (3*a*) and the external power via the control switch (9); connecting protrusions (1.1*b*) are disposed at the inner of the upper cover (1.1) respectively at least at the two sides of each sub-wire (3), and the lower seat (1.2) has connecting recesses (1.2*b*) for the corresponding connecting protrusions (1.1*b*) to insert in which are fixed with corresponding connecting protrusion (1.1*b*) through a screw.

What is claimed is:

1. A power socket comprising:

a housing (1) composed of an upper cover (1.1) and a lower seat (1.2);

a master wire (2) connecting with a master plug; and a plurality of sub-sockets (3*a*) connecting a plurality of sub-wires (3) at the periphery of the housing (1) respectively; wherein:

a pair of seat bodies (10) formed on the inner wall of the upper cover (1.1) for metal contact pieces to install;

a plurality of fixing plates (4) disposed at the side of each seat body (10);

a plurality of fixing grooves (5) formed between adjacent two fixing plates (4) and between the fixing plate (4) and the corresponding seat body (10);

each of the plurality of sub-wires (3) consisted of a fire line, a ground line and a zero line, at first ends of the plurality of sub-wires (3) all the fire lines, ground lines and zero lines are connected together respectively to form three welding points (14) which are respectively inserted in the fixing grooves (5) respectively and then connected with an output (7) of a circuit board (6), at second ends of the plurality of sub-wires (3) the plurality of sub-sockets (3*a*) are connected therein respectively.

2. The power socket of claim 1, wherein the number of the fixing plates (4) at side of each seat body (10) is three, and the three fixing plates (4) are parallel with the seat body (10), accordingly the fixing grooves at side of the each seat body (10) are three which are defined respectively as a zero line fixing groove (5.1), a fire line fixing groove (5.2) and a ground line fixing groove (5.3) from outer to the seat body (10).

3. The power socket of claim 2, wherein the width of each fixing groove (5) is uniform.

4. The power socket of claim 1 wherein the upper cover (1.1) is equipped with 2-4 three-hole socket units (8), and three holes of the three-hole socket units on the upper cover (1.1) locate in the seat bodies (10) and a place between the pair of the seat body (10), metal contact pieces (11, 12) for the fire line (3.1) or the zero line (3.2) are disposed in the seat bodies (10) and a metal contact piece (13) for the ground line (3.3) is disposed between the pair of the seat body (10).

5. The power socket of claim 4, wherein the circuit board (6) is disposed in the housing (1), an input of the circuit board (6) connects with the master wire (2), a control switch (9) is fixed on the circuit board (6), the upper cover (1.1) has a corresponding through hole to operate the control switch (9).

6. The power socket of claim 5, wherein both of the periphery of the upper cover (1.1) and the lower seat (1.2) have a plurality of half-holes (1.1*a*, 1.2*a*), the half-holes on the upper cover (1.1) respectively match with the corresponding half-holes on the lower seat (1.2) forming rounded holes respectively for each sub-wire (3) to pass through the housing (1).

7. The power socket of claim 6, wherein connecting protrusions (1.1*b*) are disposed at the inner of the upper cover (1.1) respectively at least at the two sides of each sub-wire (3), the lower seat (1.2) has connecting recesses (1.2*b*) for receiving the corresponding connecting protrusions (1.1*b*) to insert in and to fix therein by a screw.

8. The power socket of claim 7, wherein the sub-wires (3) are flexible wires, and the housings of the sub-sockets are made from insulating flexible material and the number of the sub-sockets is 4-6.

9. The power socket of claim 2 wherein the upper cover (1.1) is equipped with 2-4 three-hole socket units (8), and three holes of the three-hole socket units on the upper cover (1.1) locate in the seat bodies (10) and a place between the pair of the seat body (10), metal contact pieces (11, 12) for the fire line (3.1) or the zero line (3.2) are disposed in the seat bodies (10) and a metal contact piece (13) for the ground line (3.3) is disposed between the pair of the seat body (10).

10. The power socket of claim 3 wherein the upper cover (1.1) is equipped with 2-4 three-hole socket units (8), and three holes of the three-hole socket units on the upper cover (1.1) locate in the seat bodies (10) and a place between the pair of the seat body (10), metal contact pieces (11, 12) for the fire line (3.1) or the zero line (3.2) are disposed in the seat bodies (10) and a metal contact piece (13) for the ground line (3.3) is disposed between the pair of the seat body (10).

* * * * *